US007942636B2

(12) United States Patent
Evans

(10) Patent No.: US 7,942,636 B2
(45) Date of Patent: May 17, 2011

(54) ANNULUS FILLER SEAL

(75) Inventor: Dale Evans, Derby (GB)

(73) Assignee: Rolls-Royce, PLC, London (GB)

( * ) Notice: Subject to any disclaimer, the term of this patent is extended or adjusted under 35 U.S.C. 154(b) by 934 days.

(21) Appl. No.: 11/819,095

(22) Filed: Jun. 25, 2007

(65) Prior Publication Data

US 2008/0018056 A1 Jan. 24, 2008

(30) Foreign Application Priority Data

Jul. 22, 2006 (GB) ..... 0614640.1

(51) Int. Cl.
*F01D 5/22* (2006.01)
*F01D 1/00* (2006.01)

(52) U.S. Cl. ..... 416/193 R

(58) Field of Classification Search ..... 416/193 A, 416/191, 193 R, 248, 196 R, 500
See application file for complete search history.

(56) References Cited

U.S. PATENT DOCUMENTS

| | | | | |
|---|---|---|---|---|
| 5,037,273 | A * | 8/1991 | Krueger et al. | 416/190 |
| 5,049,035 | A * | 9/1991 | Marlin | 416/193 A |
| 5,161,949 | A * | 11/1992 | Brioude et al. | 416/193 A |
| 5,277,548 | A * | 1/1994 | Klein et al. | 416/193 A |
| 5,464,326 | A * | 11/1995 | Knott | 416/193 A |
| 5,890,874 | A * | 4/1999 | Lambert et al. | 416/193 A |
| 6,514,045 | B1 * | 2/2003 | Barton et al. | 416/193 A |
| 6,837,459 | B2 * | 1/2005 | Gonidec et al. | 244/53 B |
| 7,094,021 | B2 * | 8/2006 | Haubert | 415/115 |
| 2004/0258528 | A1 * | 12/2004 | Goga et al. | 416/193 A |

FOREIGN PATENT DOCUMENTS

| | | | |
|---|---|---|---|
| EP | 0 787 890 | A2 | 8/1997 |
| EP | 1 046 785 | A2 | 10/2000 |
| EP | 1 067 274 | A1 | 1/2001 |

* cited by examiner

*Primary Examiner* — Edward Look
*Assistant Examiner* — Jesse Prager
(74) *Attorney, Agent, or Firm* — Oliff & Berridge, PLC

(57) ABSTRACT

A seal for an annulus filler for a gas turbine engine comprises a seal body releasably attached in use to the fan annulus filler, the seal body supporting two seal members so that in use one seal member is brought into contact with, and forms a seal against, an aerofoil surface of one of the fan blades, and the other seal member is brought into contact with, and forms a seal against, an aerofoil surface of the other of the fan blades.

6 Claims, 2 Drawing Sheets

ANNULUS FILLER SEAL

This invention relates to gas turbine engines, and more particularly to mounting arrangements for fan blade assemblies in such engines.

Commonly, the root portions of a set of fan blades locate in corresponding axially-extending slots circumferentially spaced around a fan disc. To fill the spaces between the fan blades and to define the inner wall of the flow annulus, annulus fillers are used. Typically, these are located in circumferentially-extending slots in the fan disc.

To remove an annulus filler, a number of fan blades must first be removed. The annulus fillers may then be "shuffled" circumferentially until the filler to be removed is clear of its mounting slot. To facilitate this, fan blades are commonly provided with "mini-platforms". Mini-platforms extend generally circumferentially from the aerofoil surfaces of the blade, near to the root portion, and align, in use, with the annulus fillers. The mini-platforms provide some of the circumferential width that would otherwise have to be provided by the annulus fillers. When the fan blades are removed there is therefore more space available to shuffle the annulus fillers, and the number of fan blades that must be removed is minimised. Known mini-platforms are integral with the fan blades, being machined into the pressure and suction surfaces during manufacture.

The use of mini-platforms presents certain serious disadvantages in the design and operation of gas turbine engines. Mini-platforms add weight and cost to the fan blades, and it is not possible to use them at all on certain types of fan blades (for example, hollow fan blades). Furthermore, in the event that a fan blade is released during operation of the engine, the geometry of the mini-platform features can cause them to puncture the rear of the fan case of the engine. To guard against this, and because the fan blade itself is made heavier by the mini-platforms, the fan case must be of more substantial construction, adding further weight and cost.

It is therefore an object of the present invention to provide a novel fan blade arrangement which avoids the above-mentioned disadvantages, while still permitting the easy removal of the annulus fillers.

According to the invention, there is provided a seal for an annulus filler of a gas turbine engine as claimed in claim 1.

The invention will now be described, by way of example, with reference to the following drawings in which.

Figure 1:
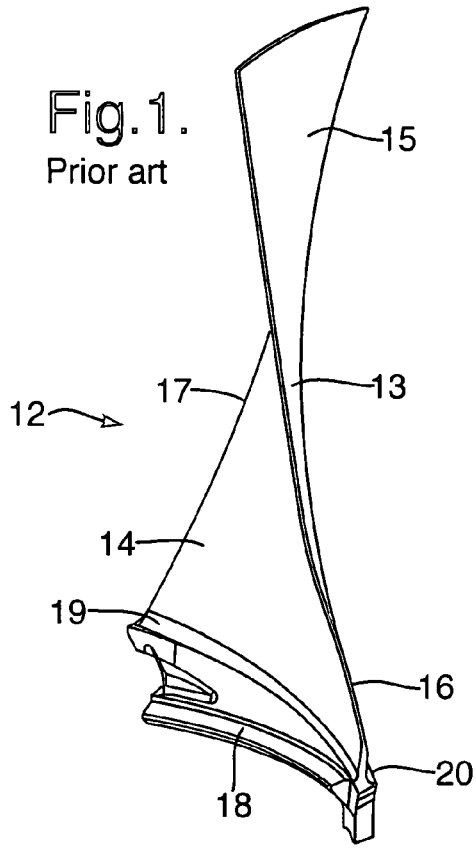
Fig.1. Prior art
FIG. 1 is a perspective view of a fan blade of known type, showing conventional, integral mini-platforms.

FIG. 1 shows a fan blade 12 of known type for a gas turbine engine. The fan blade 12 comprises an aerofoil portion 13, which has a pressure surface 14 and a suction surface 15. The pressure 14 and suction 15 surfaces extend from leading edge 16 to the trailing edge 17 of the fan blade 12. Mini-platforms 19, 20 extend from the aerofoil surfaces 14, 15. The fan blade 12 further comprises a root portion 18 which in use locates in a corresponding axial slot (24 in FIG. 2) in a fan disc (22). A plurality of slots 24 around the periphery of the disc 22 accommodates a set of fan blades 12.

Figure 2:
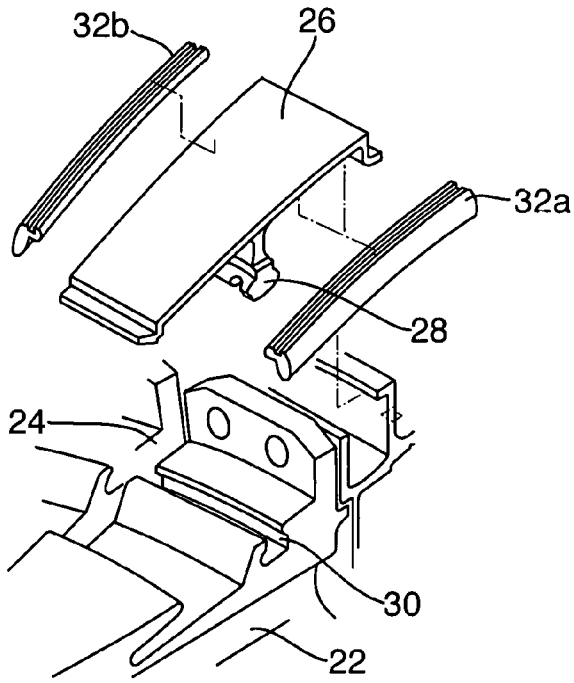
Fig.2. Prior art
FIG. 2 is a perspective view of a known annulus filler arrangement.

FIG. 2 shows a conventional fan annulus filler 26. These are located in the circumferential spaces between the fan blades 12, to provide a smooth surface which will not impede airflow into the engine. Each annulus filler 26 has a root portion 28, which in use locates in a circumferential slot 30 in the fan disc 22. A P-shaped seal 32*a* and a flap seal 32*b* are secured to the sides of the annulus filler 26, and in use bear against the pressure 14 and suction 15 surfaces of two adjacent fan blades 12 to prevent air leakage between the annulus filler 26 and the blades 12.

It is known to provide mini-platform features towards the trailing edge 17 of the fan blade 12, to permit easier removal of the annulus fillers 26. These mini-platform features are machined into the pressure 14 and suction 15 surfaces of the blade 12 during manufacture. In use, the side forces between the mini-platforms and the P-shaped seal 32*a* ensures that the annulus fillers 26 are maintained in their correct circumferential locations.

Figure 3:
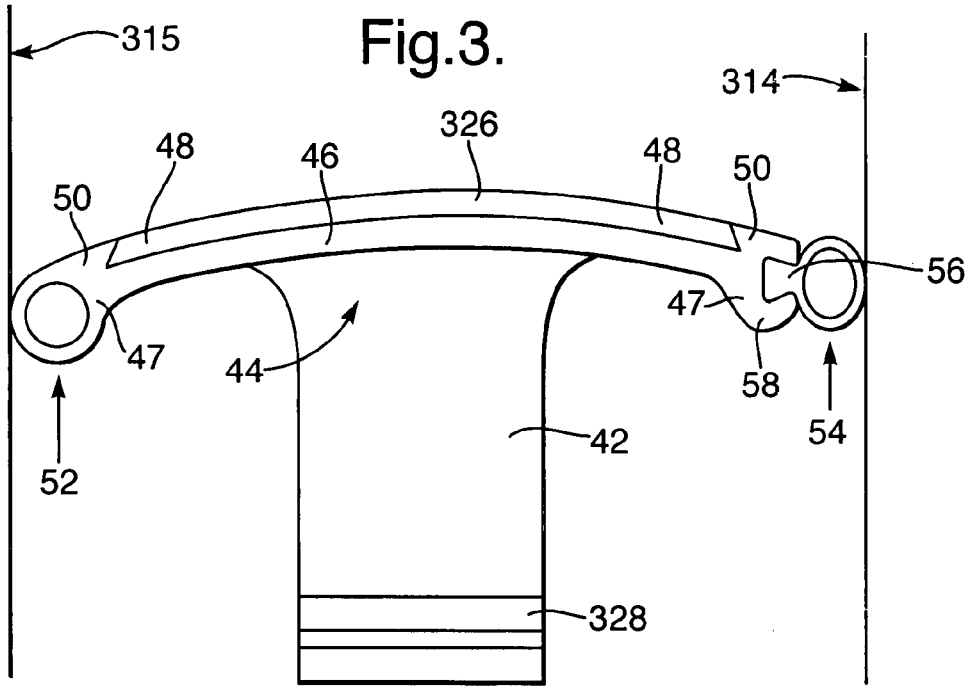
FIG. 3 is an axial sectional view of an annulus filler having a seal according to the invention.

Referring to FIG. 3, an annulus filler 326 has a root portion 328 and a body 42. In use, the annulus filler 326 is located between the aerofoil surfaces 314, 315 of two adjacent fan blades, with the root portion 328 engaging in a circumferential slot in the fan disc (not shown). To seal the gaps between the annulus filler 326 and the aerofoil surfaces 314, 315, a seal 44 is provided. A strap 46 extends beneath the annulus filler 326. A further strap 46 (not visible in this drawing) is located on the far side of the annulus filler body 42. The two straps 46 are linked by seal supports 47 to form a seal body. The seal body is produced by injection moulding. In use the seal body is secured to the chamfered ends 48 of the annulus filler 326 by correspondingly shaped recesses 50 in the seal supports 47.

In the illustrated embodiment, an integral sealing member 52 is provided in one seal support 47, and a separate sealing member 54 is provided in the other seal support 47. The separate sealing member has a protruding locating feature 56, which locates in use in a corresponding recess 58 in the seal support 47. A skilled person will, however, appreciate that both sides of the seal 44 could be provided with the same type of sealing member, either integral 52 or separate 54.

Figure 4:
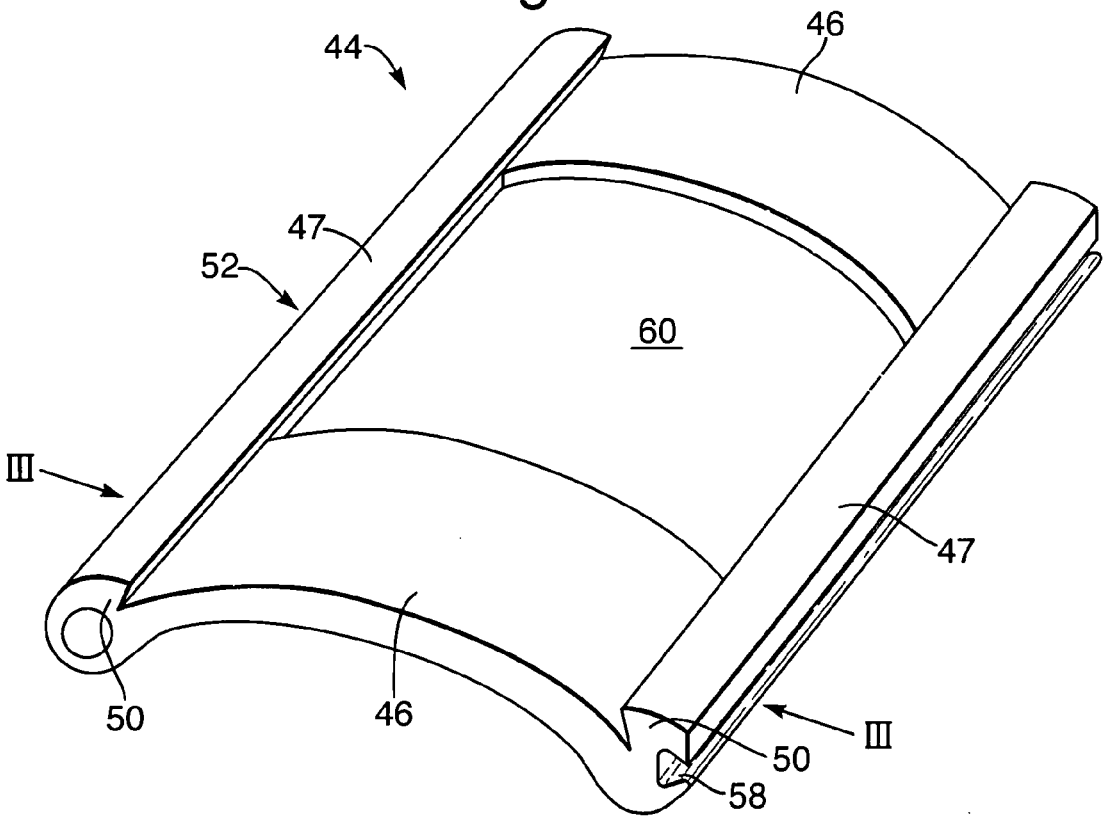
FIG. 4 is a perspective view of the seal of FIG. 3.

FIG. 4 shows a perspective view of the seal 44 body, comprising two straps 46 and two seal supports 47. To permit the detail to be seen more clearly, the annulus filler 326 and the separate sealing member 54 are not shown. The arrows III-III show the approximate position, relative to the seal 44, of the sectional view of FIG. 3.

The two straps 46 are linked by the two seal supports 47 so that in use the body 42 of the annulus filler 326 will fit through the opening 60 between them. The integral sealing member 52 extends the whole length of the seal support 47 (and in use would extend the whole length of the annulus filler 326), and likewise the separate sealing member 54 would locate in use along the whole length of the recess 58. The securing recesses 50 similarly extend along the whole length of the seal supports 47.

In use, the seal 44 body is positively located on the annulus filler 326 by the location features 48. The centrifugal force generated when the engine is running will also tend to urge the straps 46 into contact with the underside of the annulus filler 326, so as to prevent its release. The flexibility of the sealing members 52, 54 enables them to conform with the aerofoil surfaces 314, 315 of the blades, promoting effective sealing, and at the same time ensuring that the annulus filler 326 is held securely in its correct position between adjacent blades.

When it is desired to remove an annulus filler for any purpose, the seal 44 can be pushed downward to free the locating features 48 from the recesses 50. With the seal 44 removed, the effective width of the annulus filler 326 is reduced, and sufficient clearance is available to remove it from the engine without removing all the fan blades and progressively shuffling all the annulus fillers circumferentially. To re-install the annulus filler, the seal 44 is left loosely around the annulus filler body 42 while it is mounted in its circumferential groove. Once all the annulus fillers and blades are in place, the seal 44 can be snapped into place.

It will be understood that various modifications may be made to the embodiment described in this specification, without departing from the spirit and scope of the claimed invention.

For example, as explained above, both sides of the seal 44 could be provided with the same type of sealing member, either integral 52 or separate 54, instead of the arrangement shown in the particular embodiment described.

The seal body may alternatively be formed of reinforced silicone rubber.

The invention thus provides an arrangement whereby annulus fillers can be easily removed and replaced, without the need for mini platforms as in known arrangements. The invention can be applied to any type of annulus filler, and even to engines having hollow fan blades, on which mini platforms cannot be provided.

I claim:

1. A seal arrangement for an annulus filler for a gas turbine engine, the annulus filler located in use between two circumferentially-spaced fan blades, the seal comprising a seal body releasably attached in use to the fan annulus filler, the seal body supporting two seal members so that in use one seal member is brought into contact with, and forms a seal against, an aerofoil surface of one of the fan blades, and the other seal member is brought into contact with, and forms a seal against, an aerofoil surface of the other of the fan blades.

2. A seal arrangement as in claim 1, in which the seal body comprises two straps, which in use span the underside of the annulus filler.

3. A seal arrangement as in claim 2, in which the seal body further comprises two seal supports linking the two straps.

4. A seal arrangement as claimed in claim 1, in which at least one of the seal members is formed integrally with the seal body.

5. A seal arrangement as claimed in claim 1, in which the seal body is formed by injection moulding.

6. A seal arrangement as claimed in claim 1, in which the seal body is formed of reinforced silicone rubber.

* * * * *